US007094077B1

(12) United States Patent
Chen

(10) Patent No.: US 7,094,077 B1
(45) Date of Patent: Aug. 22, 2006

(54) ELECTRICAL SOCKET WITH SLIDABLE AND REMOVABLE RECEPTACLE

(76) Inventor: Chi-Wen Chen, No. 105, Alley 27, Lane 143, Chun-Kung Rd.., Taipei City (TW)

( * ) Notice: Subject to any disclaimer, the term of this patent is extended or adjusted under 35 U.S.C. 154(b) by 0 days.

(21) Appl. No.: 11/174,744

(22) Filed: Jul. 5, 2005

(51) Int. Cl.
*H01R 25/00* (2006.01)

(52) U.S. Cl. ..... 439/118; 439/209

(58) Field of Classification Search ..... 439/209, 439/115, 148, 214, 216, 118, 110, 117; 174/57
See application file for complete search history.

(56) References Cited

U.S. PATENT DOCUMENTS 2,170,300 A * 8/1939 Frank ..... 439/118
2,230,658 A * 2/1941 Stull ..... 439/118
2,310,024 A * 2/1943 Frank et al. ..... 439/121
2,437,579 A * 3/1948 Wilson ..... 439/118
3,066,273 A * 11/1962 Herrmann et al. ..... 439/118
3,081,442 A * 3/1963 Platz ..... 439/94
3,529,275 A * 9/1970 Routh ..... 439/118
5,688,132 A * 11/1997 Rogers et al. ..... 439/120
5,759,051 A * 6/1998 Cancellieri et al. ..... 439/118

* cited by examiner

*Primary Examiner*—Tulsidas C. Patel
*Assistant Examiner*—Vladimir Imas
(74) *Attorney, Agent, or Firm*—Ladas & Parry LLP

(57) ABSTRACT

An electrical socket includes a sliding rail unit and a receptacle unit disposed slidably on the sliding rail unit. The receptacle unit includes a base and a receptacle seat mounted rotatably on the base. The receptacle seat is rotatable on the base between a conducting position, where the receptacle unit is retained on the sliding rail unit, and a non-conducting position, where the receptacle unit is removable from the sliding rail unit.

5 Claims, 6 Drawing Sheets

ELECTRICAL SOCKET WITH SLIDABLE AND REMOVABLE RECEPTACLE

BACKGROUND OF THE INVENTION

1. Field of the Invention

This invention relates to an electrical socket, and more particularly to an electrical socket that includes a slidable and removable receptacle.

2. Description of the Related Art

A conventional electrical socket includes a sliding rail unit and a plurality of receptacle units disposed slidably on the sliding rail unit. Because the receptacle units cannot be removed from the sliding rail unit, however, the number of the receptacle units cannot be changed, thereby resulting in inconvenience during use.

SUMMARY OF THE INVENTION

The object of this invention is to provide an electrical socket that includes at least one slidable and removable receptacle unit.

According to this invention, an electrical socket includes a sliding rail unit and a receptacle unit disposed slidably on the sliding rail unit. The receptacle unit includes a base and a receptacle seat mounted rotatably on the base. The receptacle seat is rotatable on the base between a conducting position, where the receptacle unit is retained on the sliding rail unit, and a non-conducting position, where the receptacle unit is removable from the sliding rail unit.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
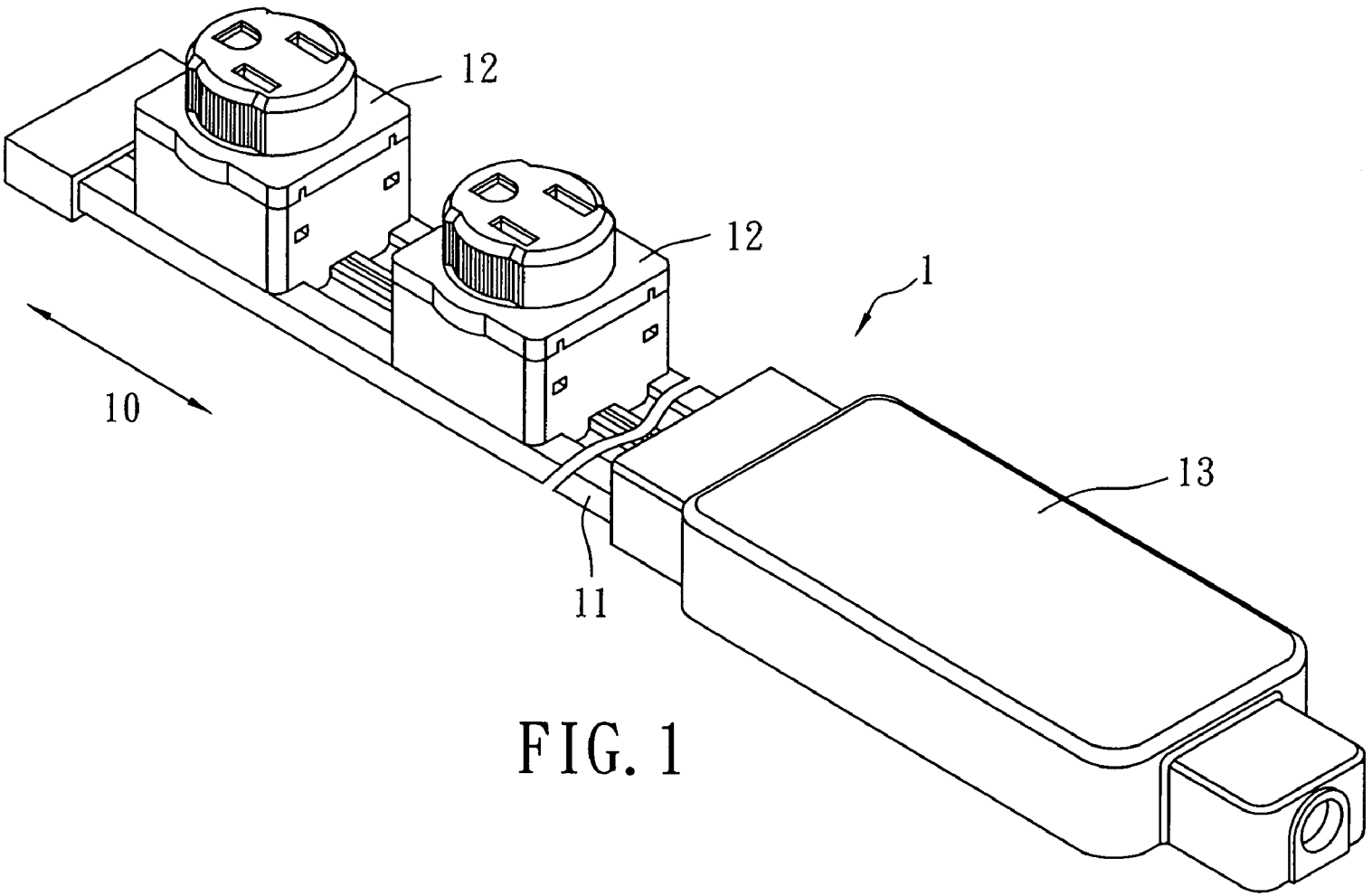
FIG. 1 is an assembled perspective view of the preferred embodiment of an electrical socket according to this invention.
Figure 2:
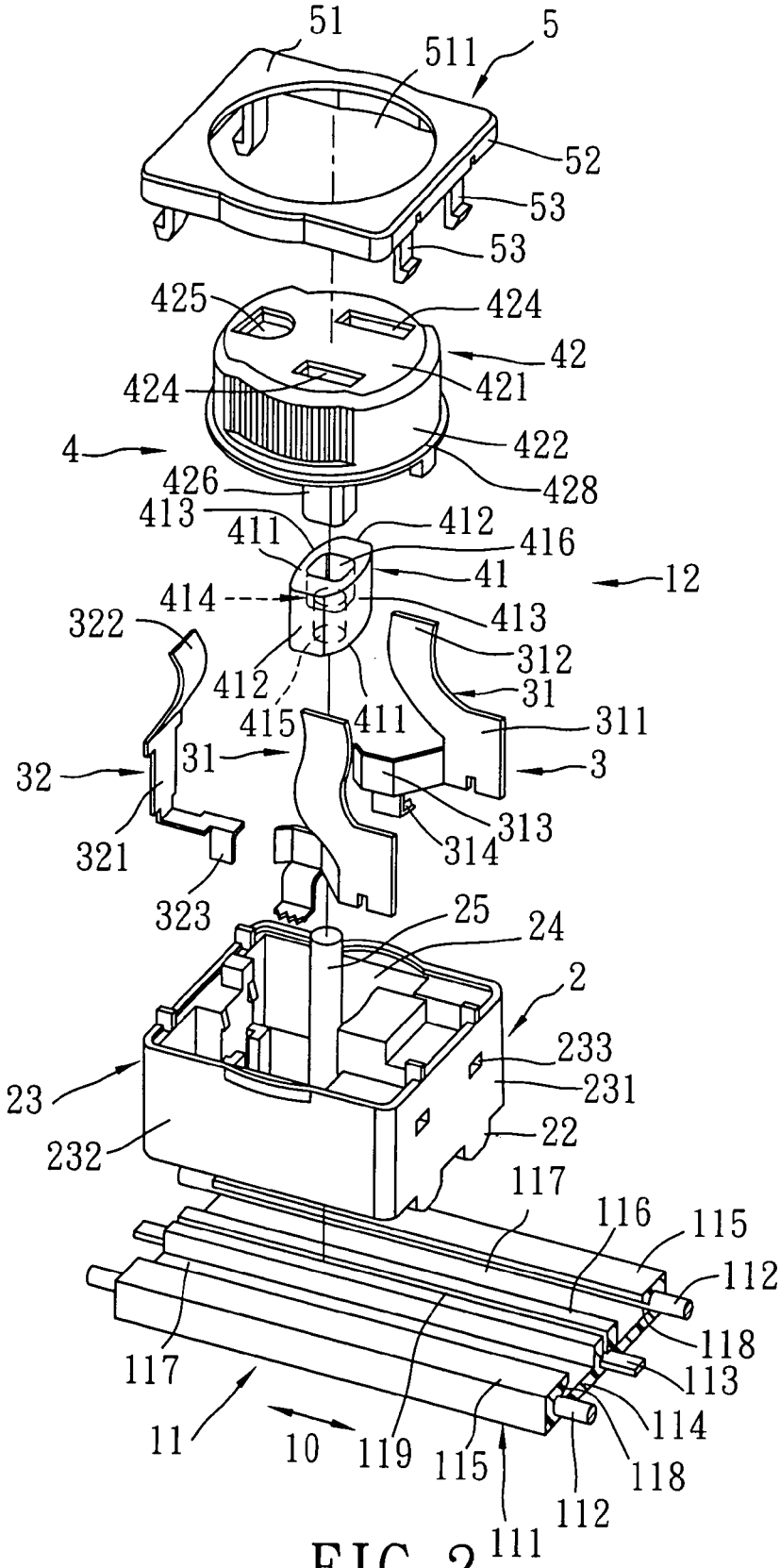
FIG. 2 is a fragmentary, partly exploded perspective view of the preferred embodiment.
Figure 3:
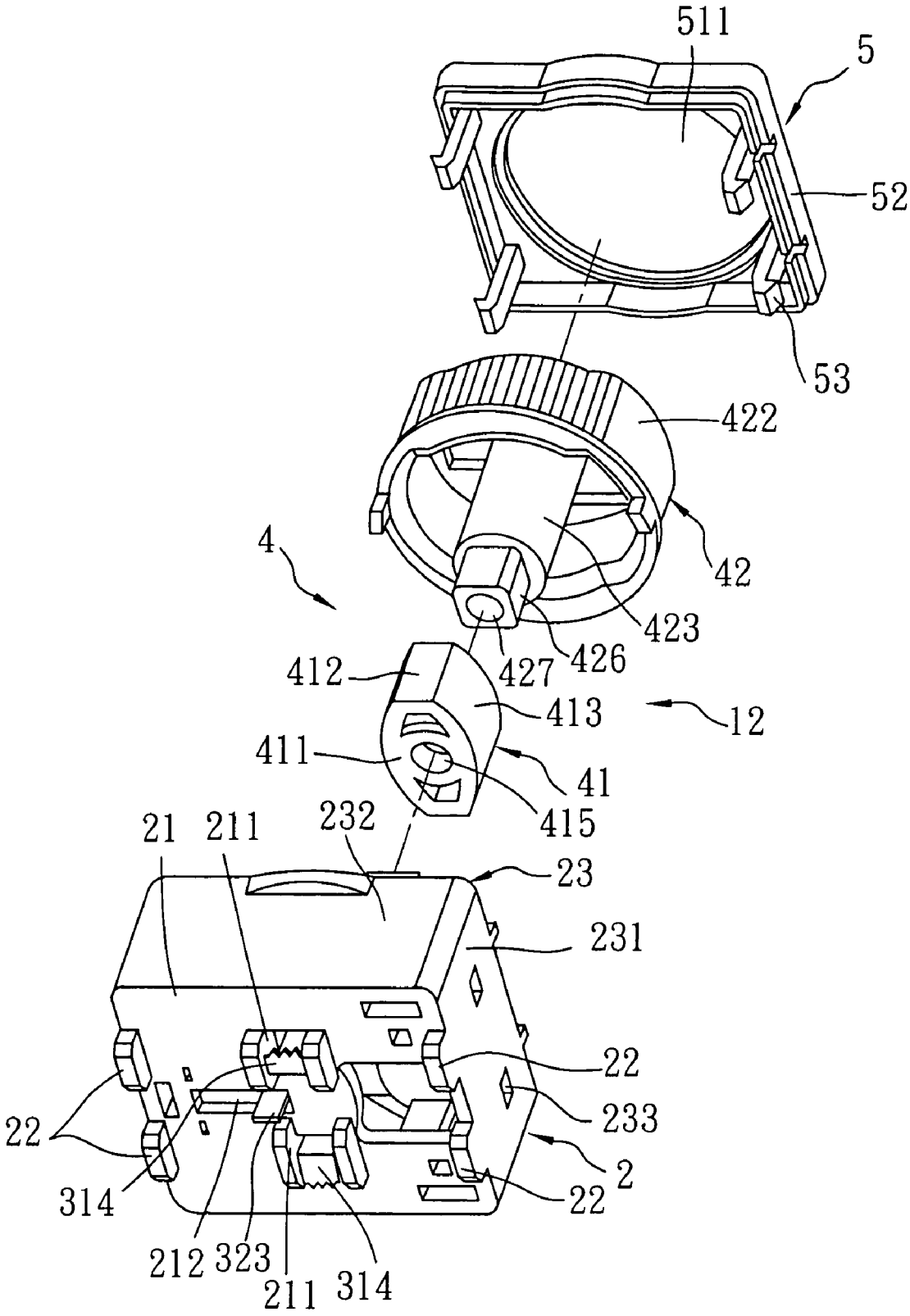
FIG. 3 is an exploded perspective view of a receptacle unit of the preferred embodiment.

Referring to FIGS. 1, 2, 3, 4, and 5, the preferred embodiment of an electrical socket according to this invention includes a sliding rail unit 11, a plurality of receptacle units 12 and a power supply unit 13. The receptacle units 12 are slidable along a longitudinal direction 10 (see FIG. 1) of the sliding rail unit 11. The sliding rail unit 11 includes an elongated sliding rail seat 111, two power wires 112 and a grounding wire 113. The sliding rail seat 111, the power wires 112 and the grounding wire 113 extend along the longitudinal direction 10. The sliding rail seat 111 has a horizontal rail wall 114, two elongated hollow power wire-mounting walls 115, a grounding wire-mounting wall 116, and two parallel slide slots 117. The grounding wire-mounting wall 116 is disposed between the power wire-mounting walls 115. Each of the slide slots 117 is disposed between the grounding wire-mounting wall 116 and a respective one of the power wire-mounting walls 115, and is adjacent to the corresponding power wire-mounting wall 115. Each of the power wire-mounting walls 115 defines a mounting space for mounting the corresponding power wire 112 therein, and is formed with a retaining groove 118 communicated with the mounting space in the corresponding power wire-mounting wall 115 as well as with the corresponding slide slot 117. The grounding wire-mounting wall 116 also defines a mounting space for mounting the grounding wire 113 therein, and has a top surface that is formed with an elongated opening 119. Each of the power wires 112 and the grounding wire 113 has an end connected electrically to the power supply unit 13. The power supply unit 13 may be configured as an electrical plug.

One of the receptacle units 12 will be described in the succeeding paragraphs.

The receptacle unit 12 is disposed above the sliding rail unit 11, and includes a base 2, a conducting unit 3, a receptacle seat 4 and a cover ring 5. The base 2 is made of a plastic material, and includes a base wall 21, two limiting ribs 22, a surrounding wall 23, an accommodating chamber 24 and an insert rod 25 that has a circular cross section. The base wall 21 bridges the power wire-mounting walls 115, and is formed with two first openings 211 (see FIG. 3) aligned respectively with the retaining grooves 118 in the power wire-mounting walls 115, and a second opening 212 (see FIG. 3) aligned with the opening 119 in the grounding wire-mounting wall 116. The limiting ribs 22 extend downwardly from the base wall 21, and are disposed respectively and movably within the slide slots 117 in the sliding rail seat 111. The surrounding wall 23 extends upwardly from an outer periphery of the base wall 21, and defines the accommodating chamber 24. The surrounding wall 23 is rectangular, and has two parallel first walls 231 perpendicular to the longitudinal direction 10, and two parallel second walls 232 parallel to the longitudinal direction 10. Each of the first walls 231 is formed with two retaining holes 233. The insert rod 25 extends upwardly from the center of the base wall 21, and is disposed in the accommodating chamber 24.

Figure 5:
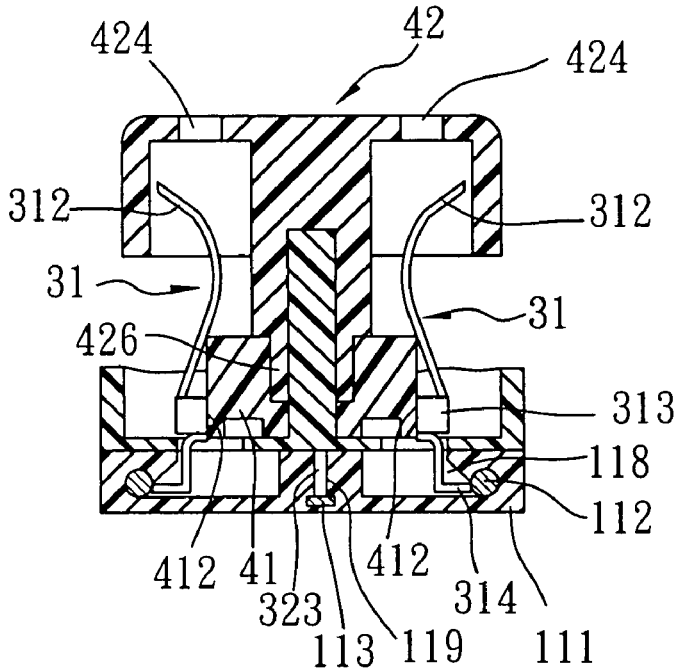
FIG. 5 is a cross-sectional view of the preferred embodiment when the receptacle seat is disposed at the conducting position.

The conducting unit 3 includes two spaced-apart conducting plates 31 and a grounding plate 32. Each of the conducting plates 31 is disposed on the base 2, and has a vertical base portion 311 disposed in the accommodating chamber 24, a curved prong-engaging portion 312 extending upwardly from an upper end of the base portion 311, and a curved wire-engaging portion 313 extending from a lower end of the base portion 311 and having a lower end contact portion 314. The prong-engaging portions 312 extend initially from the base portions 311 toward each other, and then away from each other, as shown in FIG. 5. The wire-engaging portions 313 extend respectively into the slide slots 117 through the first openings 211 in the base wall 21 of the base 2. The contact portions 314 extend away from each other, as shown in FIG. 5, and are in electrical contact with the power wires 112, respectively, by extending effectively into the retaining grooves 118. The grounding plate 32 is disposed in the accommodating chamber 24, and includes a vertical base portion 321, a curved prong-engaging portion 322 extending from an upper end of the base portion 321, and a grounding wire-engaging portion 323. The grounding wire-engaging portion 323 extends through the second opening 212 in the base 2 and into the opening 119 in the grounding wire-mounting wall 116, to therefore be in electrical contact with the grounding wire 113.

The receptacle seat 4 is mounted rotatably on the insert rod 25, and includes a driving block 41 and a rotary button 42. The driving block 41 is generally elliptical, and has opposite top and bottom surfaces 411, two opposite vertical pushing surfaces 412, two opposite curved non-pushing surfaces 413, and a hole 414 formed through the driving block 41. The distance between the pushing surfaces 412 is greater than that between the non-pushing surfaces 413. The hole 414 has a lower circular hole portion 415 and an upper non-circular hole portion 416. The driving block 41 is disposed between the rotary button 42 and the base 2. The rotary button 42 includes a top wall 421, a surrounding wall 422 extending downwardly from an outer periphery of the top wall 421, and a mounting rod 423 extending downwardly from the center of the top wall 421. The top wall 421 is formed with two power prong-engaging holes 424 and a grounding prong-engaging hole 425. The prong-engaging portion 322 of the grounding plate 32 is disposed in proximity to the grounding prong-engaging hole 425. The mounting rod 423 has a non-circular insert portion 426 engaging fittingly the non-circular hole portion 416 of the hole 414 in the driving block 41 so as to allow for synchronous rotation of the rotary button 42 and the driving block 41, and a bore 427 engaging fittingly an upper end of the insert rod 25 so as to allow for rotation of the rotary button 42 about the insert rod 25. The surrounding wall 422 has a lower end that is formed with an annular flange 428 extending radially and outwardly therefrom.

The cover ring 5 has an annular horizontal plate 51 defining a circular hole 511, a surrounding wall 52 extending downwardly from an outer periphery of the horizontal plate 51, and four retaining hooks 53 extending downwardly from the surrounding wall 52. The cover ring 5 is sleeved on the rotary button 42, and abuts against a top surface of the annular flange 428 of the rotary button 42. The retaining hooks 53 engage respectively the retaining holes 233 in the base 2 so as to confine the rotary button 42 between the cover ring 5 and the base 2.

Figure 4:
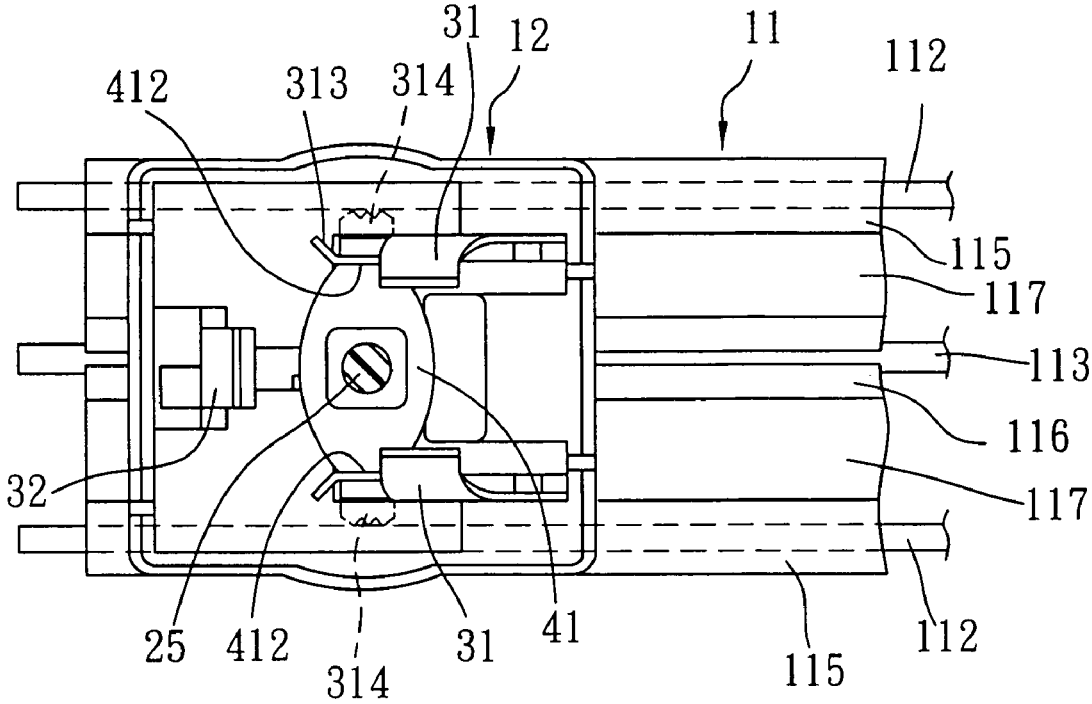
FIG. 4 is a fragmentary, partly sectional top view of the preferred embodiment when a receptacle seat is disposed at a conducting position.
Figure 8:
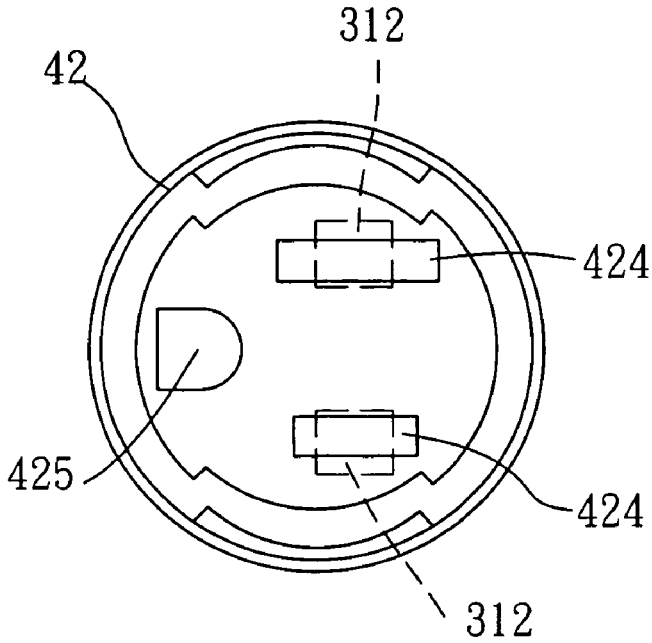
FIG. 8 is a schematic top view illustrating positions of two power prong-engaging holes in a rotary button relative to two spaced-apart conducting plates when the receptacle seat is disposed at the conducting position.

Referring to FIGS. 2, 4, 5, and 8, the receptacle seat 4 is normally disposed at a conducting position shown in FIGS. 4, 5 and 8, where the pressing surfaces 412 of the driving block 41 press respectively against the wire-engaging portions 313 of the conducting plates 31 so as to maintain the positioning of the receptacle seat 4. In the conducting position, the power prong-engaging holes 424 in the receptacle seat 4 are aligned respectively with the prong-engaging portions 312 of the conducting plates 3, as shown in FIG. 8, so as to allow for electrical contact of two power prongs of a plug (not shown) with the prong-engaging portions 312 of the conducting plates 31 when the plug is inserted into the power prong-engaging holes 424. Also in the conducting position, the contact portions 314 of the conducting plates 31 extend respectively through the retaining grooves 118 in the power wire-mounting walls 115, and are in electrical contact with the power wires 112. Because of engagement between the conducting plates 31 and the retaining grooves 118, removal of the receptacle unit 12 from the sliding rail unit 11 can be prevented.

Figure 6:
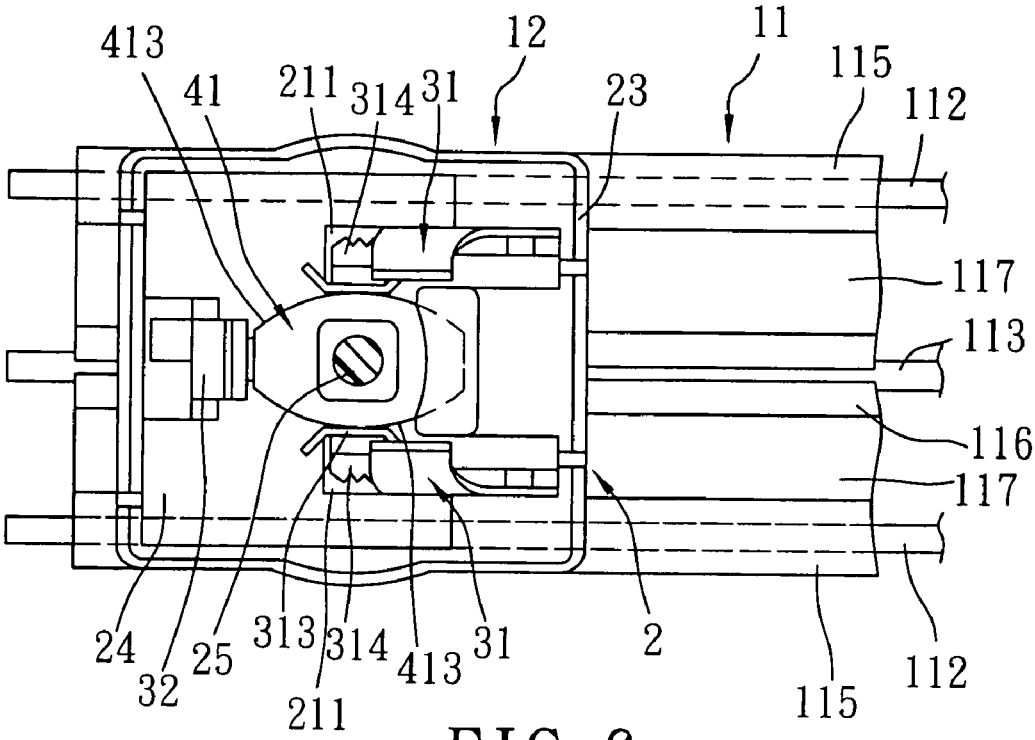
FIG. 6 is a fragmentary, partly sectional top view of the preferred embodiment when the receptacle seat is disposed at a non-conducting position.
Figure 7:
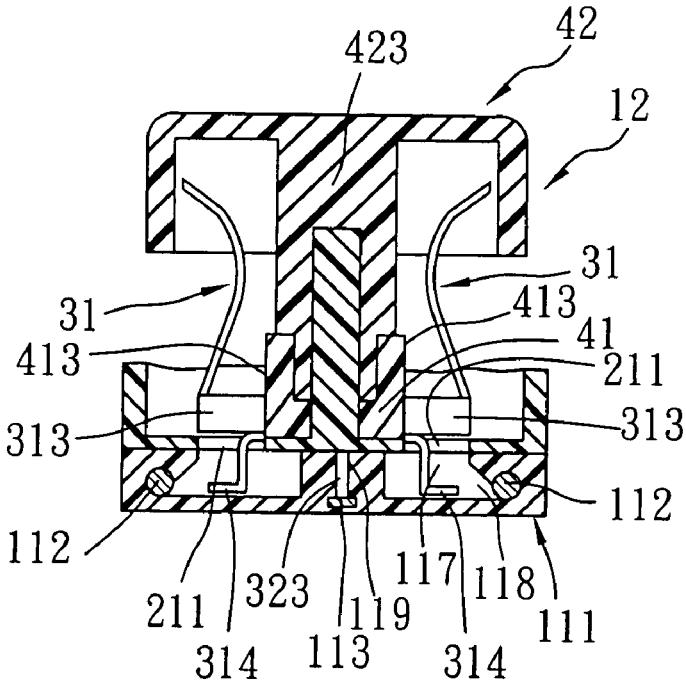
FIG. 7 is a cross-sectional view of the preferred embodiment when the receptacle seat is disposed at the non-conducting position.
Figure 9:
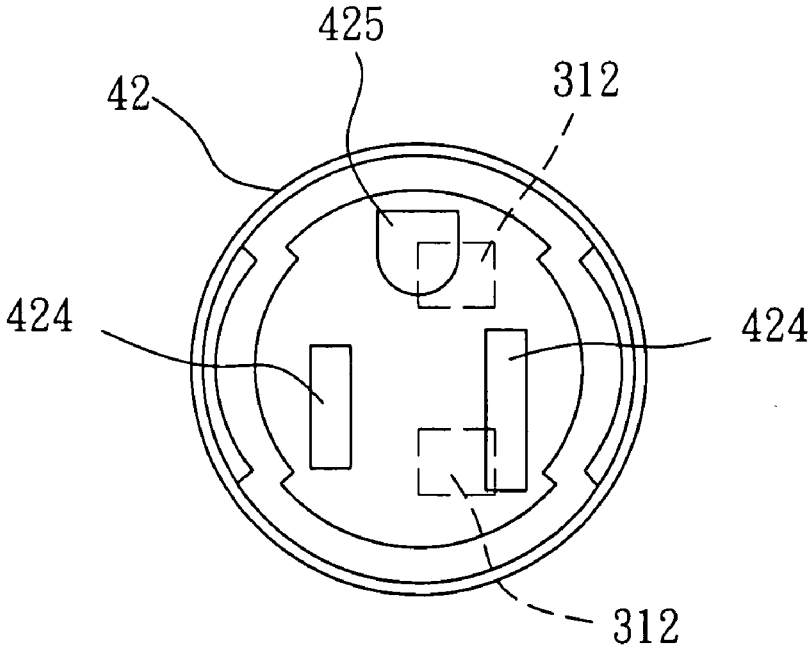
FIG. 9 is a schematic top view illustrating positions of two power prong-engaging holes in a rotary button relative to two spaced-apart conducting plates when the receptacle seat is disposed at the non-conducting position.

The rotary button 42 can be operated to rotate the receptacle seat 4 by 90° to a non-conducting position shown in FIGS. 6, 7 and 9, where the non-pressing surfaces 413 are aligned respectively with the prong-engaging portions 312 of the conducting plates 31 so as to maintain the positioning of the receptacle seat 4. In the non-conducting position, each of the power prong-engaging holes 424 in the receptacle seat 4 is deflected from the prong-engaging portion 312 of the corresponding conducting plate 31, as shown in FIG. 9. As a result, when the plug is inserted into the receptacle unit 12, because one of the power prongs of the plug is blocked by one of the conducting plates 31, the power prongs of the plug cannot be inserted completely into the power prong-engaging holes 424. This prevents electrical contact between the plug and both the conducting plates 31. Also in the non-conducting position, the contact portions 314 of the conducting plates 31 are removed from the retaining grooves 118 in the power wire-mounting walls 115 and, therefore, as well as the power wires 112. This allows for removal of the receptacle unit 12 from the sliding rail unit 11.

With this invention thus explained, it is apparent that numerous modifications and variations can be made without departing from the scope and spirit of this invention. It is therefore intended that this invention be limited only as indicated by the appended claims.

I claim:

1. An electrical socket comprising:

a sliding rail unit including a sliding rail seat and two parallel power wires extending along a longitudinal direction of said sliding rail seat, said sliding rail seat having two elongated hollow power wire-mounting walls each defining a mounting space for mounting a respective one of said power wires therein, and two parallel slide slots disposed respectively adjacent to said power wire-mounting walls, each of said power wire-mounting walls being formed with a retaining groove communicated with a corresponding one of said slide slots and a corresponding one of said mounting spaces in said power wire-mounting walls; and a receptacle unit disposed above said sliding rail unit and including a base, two spaced-apart conducting plates disposed on said base, each of said conducting plates having a wire engaging portion extending into the corresponding one of said slide slots in said sliding rail seat, and a prong-engaging portion disposed above said wire-engaging portion, and a receptacle seat mounted rotatably on said base and having a top wall that is formed with two power prong-engaging holes, said receptacle seat being disposed at a conducting position, where said power prong-engaging holes in said top wall of said receptacle seat are aligned respectively with said prong-engaging portions of said conducting plates, and where said wire-engaging portions of said conducting plates extend respectively through said retaining grooves in said power wire-mounting walls to contact respectively and electrically said power wires so as to prevent removal of said receptacle unit from said sliding rail unit, said receptacle seat being rotatable on said base to a non-conducting position, where each of said power prong-engaging holes in said receptacle seat is deflected from a corresponding one of said prong-engaging portions of said conducting plates, and where said conducting plates are removed from said retaining grooves in said power wire-mounting walls and said power wires so as to allow for removal of said receptacle unit from said sliding rail unit;

wherein said base of said receptacle unit includes a base wall disposed slidably on said power wire-mounting walls, and an insert rod fixed on said base wall, said receptacle seat being sleeved rotatably on said insert rod; and wherein said receptacle seat further includes a rotary button sleeved rotatably on an end of said insert rod of said base and formed with said power prong engaging holes, and a driving block sleeved rotatably on said insert rod of said base and disposed between said base and said rotary button, said driving block being rotatable synchronously with said rotary button about said insert rod of said base and having two opposite pushing surfaces and two opposite non positioning surfaces, a distance between said non-pushing surfaces being smaller than that between said pushing surfaces, said pushing surfaces pressing respectively against said wire engaging portions of said conducting plates when said receptacle seat is disposed at said conducting position, said non-pushing surfaces being aligned respectively with said wire-engaging portions of said conducting plates when said receptacle seat is disposed at said non-conducting position.

2. The electrical socket as claimed in claim 1, wherein said base wall is formed with two limiting ribs extending downwardly therefrom and disposed respectively and movably within said slide slots.

3. The electrical socket as claimed in claim 1, wherein said insert rod has a circular cross section, said driving block being formed with a hole having a circular hole portion and a non-circular hole portion, said insert rod of said base extending through said hole in said driving block and engaging fittingly said circular hole portion, said rotary button being formed with an insert portion engaging fittingly said non-circular hole portion of said hole in said driving block so as to allow for synchronous rotation of said rotary button and said driving block.

4. The electrical socket as claimed in claim 1, wherein said receptacle seat further includes a surrounding wall extending upwardly from an outer periphery of said base wall and having a plurality of retaining holes, said rotary button being further formed with an annular flange extending radially and outwardly from a lower end thereof, said receptacle unit further including a cover ring that is sleeved on said rotary button and that abuts against a top surface of said annular flange, said cover ring being formed with a plurality of retaining hooks engaging respectively said retaining holes in said surrounding wall of said base so as to confine said rotary button between said cover ring and said base.

5. The electrical socket as claimed in claim 1, wherein said sliding rail unit further includes a grounding wire, said sliding rail seat of said sliding rail unit further having a grounding wire-mounting wall that defines a mounting space for mounting said grounding wire therein, said grounding wire mounting wall being formed with an opening, said receptacle seat being further formed with a grounding prong-engaging hole, said receptacle unit further including a grounding plate that is mounted on said base and that has a prong-engaging portion disposed in proximity to said grounding prong-engaging hole in said receptacle seat when said receptacle seat is disposed at said conducting position, said grounding plate further having a wire-engaging portion disposed below said prong-engaging portion of said grounding plate, said wire-engaging portion of said grounding plate extending through said opening in said grounding wire-mounting wall and being in electrical contact with said grounding wire.

* * * * *